United States Patent [19]

Zikmanis et al.

[11] Patent Number: 4,635,304

[45] Date of Patent: Jan. 13, 1987

[54] WALL SYSTEM FOR SWIMMING POOLS

[75] Inventors: Harijs Zikmanis, East Brunswick; James Prezlock, Somerset; Paul Lahaski, Middlesex, all of N.J.

[73] Assignee: Cascade Industries, Inc., Edison, N.J.

[21] Appl. No.: 727,997

[22] Filed: Apr. 29, 1985

[51] Int. Cl.[4] ..... E04H 3/18

[52] U.S. Cl. ..... 4/506; 4/488; 52/169.7

[58] Field of Search ..... 4/506, 488, 169.7, 169.8, 4/245

[56] References Cited

U.S. PATENT DOCUMENTS

| | | | |
|---|---|---|---|
| 4,055,922 | 11/1977 | Ellington et al. | 4/506 X |
| 4,124,907 | 11/1978 | Laven | 4/506 X |
| 4,167,084 | 9/1979 | Brunton | 4/506 X |
| 4,177,614 | 12/1979 | Arp | 4/506 |
| 4,283,804 | 8/1981 | Mahoney | 4/506 |

*Primary Examiner*—Henry K. Artis

*Attorney, Agent, or Firm*—Sperry, Zoda & Kane

[57] ABSTRACT

A swimming pool, of the type having a sectionally constructed wall extending about and supporting a plastic liner, incorporates in the wall a capability of forming a wide variety of swimming pools of different shapes and sizes. Disclosed is a wall system which basically comprises a relatively small number of different types of sections. Each section has a flat web and side flanges disposed at selected obtuse or acute angles to the plane of the web. The angles incorporated in each section differ from those of the remaining sections. In this way, by abutting against each other selected sections, and by utilizing a selected number of such sections along different portions of the periphery of a swimming pool, it becomes possible to provide an almost infinite variety of swimming pool shapes and sizes.

8 Claims, 12 Drawing Figures

WALL SYSTEM FOR SWIMMING POOLS

BACKGROUND OF THE INVENTION

1. Field of the Invention

The present invention relates generally to swimming pool construction, of the type wherein a sectional, prefabricated swimming pool wall is erected about an excavation, and supports a vinyl liner. Typically, the edge of the liner is engaged in a liner clamp incorporated in a coping and coping receptor assembly mounted upon the sectionally formed wall.

In a more particular sense, the invention relates to the construction of the panels that make up the swimming pool wall, and in yet a more particular sense, the invention relates to forming said panels in such a way as to produce swimming pool configurations of different shapes and sizes.

2. Description of the Prior Art

Heretofore, in swimming pools of the type described above, it has been proposed to incorporate in the wall construction a capability for varying the shapes and sizes of a swimming pool, according to the desires of the customer for whom the pool is being erected.

Various concepts have been disclosed for this purpose, but in general, they have for one reason or another not found widespread commercial acceptance. In some instances, it has been proposed that panels be of curved formation, and this has been found undesirable because the pre-curved panels are expensive to make and fail to take account of the fact that in abutting a panel curved to one radius against a panel curved to another radius, the side edges of the panels will not be in full face-to-face contact, and would require the insertion of shims between the confronting side edges of the panels, or the use of other equally undesirable expedients.

It has also been proposed to provide panels between which wedge elements are interposed, for the purpose of disposing adjacent panels at selected angles to each other. This, however, has the disadvantage of requiring an excessive number of wall components, and in addition requires extra long connecting bolts between adjacent panels, creating a tendency toward loosening the connections between such panels, precise fitting of the wedge elements, and very importantly, the use of excessive time on the part of the labor crew at the site at which the swimming pool is being constructed.

It has been proposed, additionally, in the construction of hot tubs, to utilize staves of solid construction, having side edges disposed at angles such as to produce a circular tub when the staves are assembled with one another. However, the utilization of solid staves would be impractical for the construction of swimming pools, since swimming pools must have means for directly connecting the adjacent, abutting portions of adjacent wall panels or wall sections directly to each other in a strong, rigid assembly which, by reason of being subsequently back-filled and hence below the ground surface, must in the final analysis be considered as capable of standing up without deterioration, on a permanent basis.

The main object of the present invention is to provide a wall system for swimming pools, which will afford an unlimited number of pool sizes and shapes, utilizing no more than perhaps six or seven basic, modular wall panels.

Another important object is to provide a modular wall system of the character described which will include wall panels that are relatively light, and yet will have great strength, as well as the capability of resisting deteriorative forces occurring by reason of the in-ground installation of the swimming pool, as well as forces resulting from the filling of the pool with water and the normal use of the pool over an indefinite period of time.

Still another object is to provide a capability for forming a wide variety of pools of different shapes and sizes from a relatively few wall panels, while still permitting construction of the pool with a relatively small work force, that will still be able to complete construction of a swimming pool over no greater a length of time than has heretofore been required for swimming pools not having the desirable features of the present invention.

SUMMARY OF THE INVENTION

Summarized briefly, the invention comprises a modular wall panel structure for swimming pools, in which each panel is formed as a light, strong, one-piece, reinforced structure of high-impact polystyrene plastic or its equivalent. Each panel, thus, includes a flat web or body, integral at top and bottom with top and bottom flanges, and also integrally formed at its opposite sides with vertical side flanges. Suitable reinforcement is incorporated in the integral panel construction, through the provision of crossing vertical and horizontal reinforcing ribs.

Each panel is formed, in the side flanges thereof, with means adapted to mate with complementary means provided on an adjacent, abutting side flange of the next adjacent wall panel, whereby to interfit adjacent panels in abutting relationship. Fastening means are extended through the mating means, for rigidly connecting the wall panels with their adjacent side flanges in abutting, face-to-face engagement.

The side flanges of each panel are disposed at selected angles to the plane of the web of the panel. In the modular system incorporated in the invention, there may be, for example, only a limited number of wall panels, perhaps six or seven in all. The described angle of each panel differs from the corresponding angle of all the other panels. As a result, a customer may specify a particular shape of pool, as for example, a kidney-shaped pool, one end of which may be formed on a radius greater than the other end, as a result of which a number of panels of one angle may form the larger end, another assemblage of panels may form a continuation of the periphery of the pool from said end, to form a reentrant portion or portions, and yet another line of panels may be utilized to form a curving end on a smaller radius than the first end. Other shapes, including oval, round, teardrop, and others, can be selected, each in any desired size.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DESCRIPTION OF THE PREFERRED EMBODIMENTS

Figure 1:
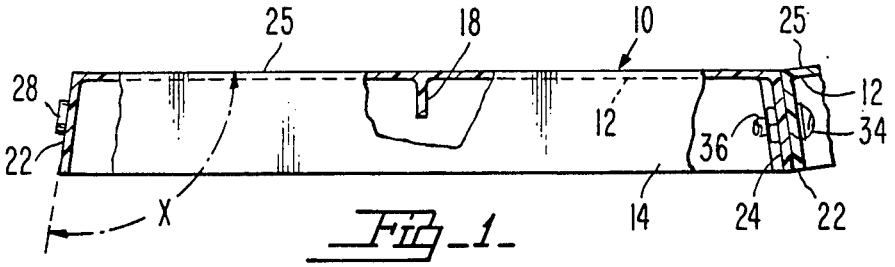
FIG. 1 is an upper end elevational view of one of the panels, portions being broken away, an adjacent, connected panel being shown fragmentarily and in section.
Figure 3:
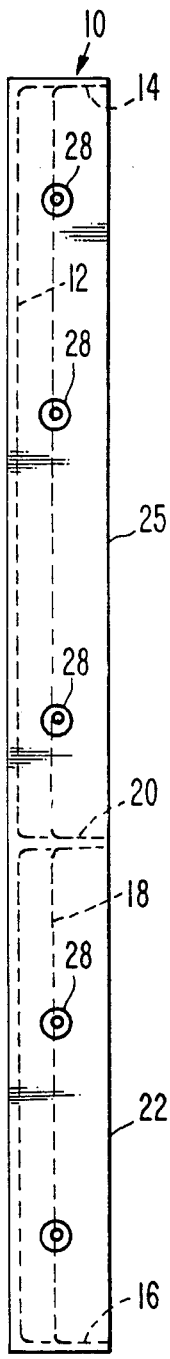
FIG. 3 is a side edge elevational view of the panel, as seen from the left of FIG. 2.
Figure 2:
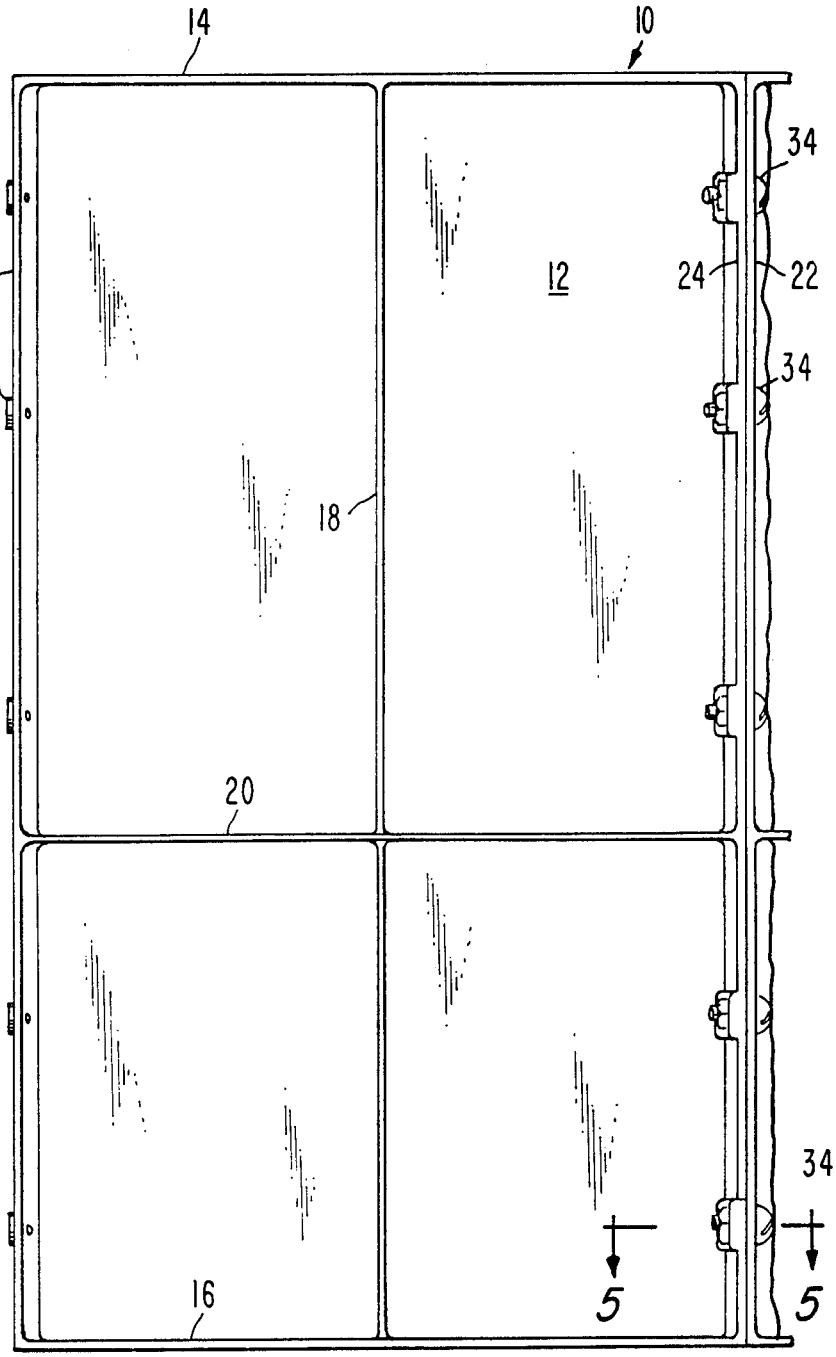
FIG. 2 is an elevational view of the panel shown in FIG. 1, showing the outer face of the panel, the adjacent, connected panel being shown fragmentarily.
Figure 4:
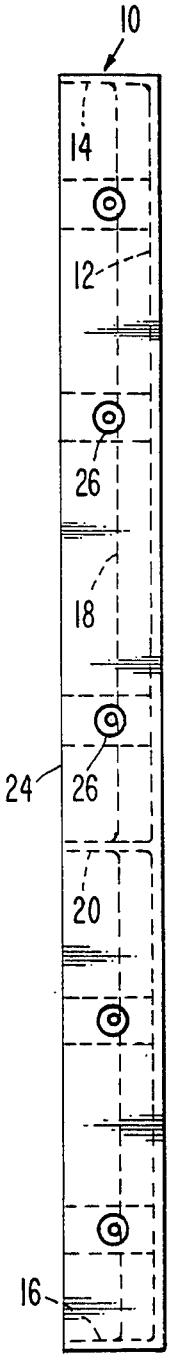
FIG. 4 is an edge elevational view of the panel, showing the side opposite that shown in FIG. 3.

In the form of the invention shown in FIGS. 1–5, there is illustrated a wall panel generally designated 10 comprising an integral one-piece member formed wholly of, preferably, high-impact polystyrene, and including a wholly flat, rectangular, upstanding web or body 12 integrally formed with a top flange 14, a bottom flange 16, a vertical reinforcing rib 18, a horizontal reinforcing rib 20, a first side flange 22, and a second side flange 24. The several flanges and ribs extend outwardly from the plane of the web, that is, outwardly in the sense of the pool area defined by a swimming pool wall constructed with the modular panels comprising the present invention. As a result, the flat, inner surface 25 of the web 12 provides a wholly unbroken, smooth surface, against which the conventional vinyl liner, not shown, would be pressed flat by the water confined in the pool.

Recesses 26 vertically spaced along the length of the side flange 24 of each panel, mate with bosses 28 formed on the flange 22 of an adjacent, abutting panel (see FIG. 5), to interfit the abutting panels in a manner such as to assure that the top surfaces thereof will be flush, and that the panels will be in the exact, face-to-face, abutting relationship desired for the finally assembled wall system. Formed in the flanges 22, 24, in concentric relation to the mating bosses and recesses, are openings 30, 32, receiving connecting bolts 34 provided with nuts 36.

In this way, by positioning selected panels in adjacent, abutting relation, a complete and continuous swimming pool wall can be swiftly erected.

The panel illustrated in FIGS. 1–5 is utilized for forming areas of the pool periphery that are curved outwardly in respect to the water confining pool area. In FIGS. 6–9, there is illustrated a panel which is used to form reentrant areas, i.e., portions of the wall that are curved inwardly. This panel is essentially the same as the panel shown in FIGS. 1–5, except for the fact that the angle defined between the plane of the web of the panel and outer surface of each side flange is opposite that illustrated and described with respect to the first panel illustrated in FIGS. 1–5. In all other respects the panel of FIGS. 6–9 is the same as the panel previously described herein, in the sense of the manner in which the panel was made. Thus, the panel 38 of FIGS. 6–9 is formed as a one-piece, high-impact polystyrene member including a wholly flat web 40 of rectangular configuration, having a flat surface 41 facing inwardly of the water-confining pool area, so as to provide a smooth flat area against which the liner of the pool would be pressed, and further having top and bottom flanges 42, 44 respectively, crossing reinforcing ribs 46, 68, and first and second side flanges 50, 52 having mating bosses and recesses 54, 56 respectively. These panels would be connected to adjacent, abutting panels in the same manner as has been described with respect to the panel of FIGS. 1–5.

Figure 11:
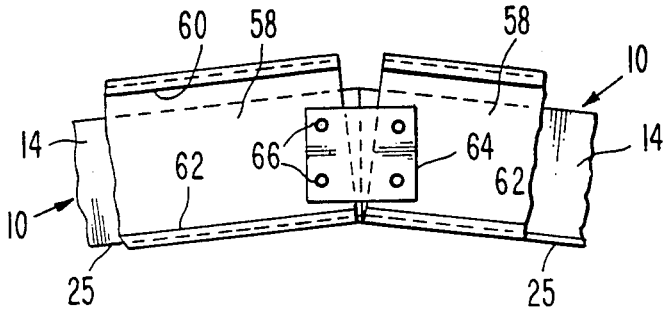
FIG. 11 is an enlarged, fragmentary, top plan view of the swimming pool wall illustrating the manner in which coping receptors are attachable thereto.

In FIG. 11, there is illustrated a typical arrangement wherein the adjacent panels 10, when connected in abutting relation in the manner previously described herein, are adapted to serve as a support for a coping assembly. By way of example, typical, conventional, extruded metal coping receptors 58 are positioned upon the top flanges 14, and as is usual, have flanges 60 adapted to receive mating, flanged portions of extruded metal copings, not shown. Along the opposite longitudinal edges of the coping receptors, that is, along the edges of the receptors that are disposed substantially flush with the liner-engaging faces 25 of the abutting panels, the receptors are provided with liner clamps 62, also of conventional design. As well understood in the trade, the liners have top edges which are folded over the upstanding inner longitudinal edges of the receptors, and are held in place by liner clamps, which are thereafter pressed downwardly by the copings, when the copings are interengaged with the coping receptors.

The manner in which the liner, the copings, the liner clamps, and coping receptors will be assembled with each other and with the top of the swimming pool wall is fully disclosed in U.S. Pat. No. 3,440,780 issued to Adam et al. on Apr. 29, 1969 and assigned to the assignee of the present application. The disclosure of that patent is incorporated in the present application by reference.

The fasteners 66, it may be noted, are used for attaching a splice plate 64 to the coping receptors, would preferably be the self-drilling type, and would extend directly downwardly through the top flanges 42, so as to rigidly and permanently connect the several coping receptors to the wall panels.

It may now be noted, from FIG. 1, that the outer faces of the side flanges 22, 24 of each panel 10 are disposed at an obtuse angle to the flat, liner-engaging face 25 of the web 12 of the panel. Conversely, the outer face of each side flange of panel 38 is at an acute angle to the liner-engaging face or surface 41 of said panel 38.

In actual practice, a typical modular wall system would include, for example, seven different types of wall panels, six of which might be of the type shown in FIGS. 1–5, wherein the faces of the side flanges are at obtuse angles "X" to the panel web, while one panel might be used with the faces of the side flanges at an acute angle "Y" to the web in the manner shown in FIGS. 6–9.

Figure 6:
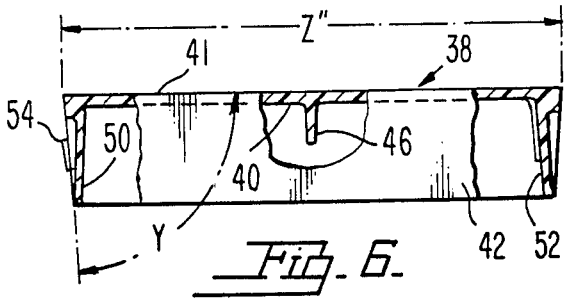
FIG. 6 is an upper end elevational view of a modified form of panel used in the construction of reentrant curved sections of a swimming pool, partly in section.
Figure 9:
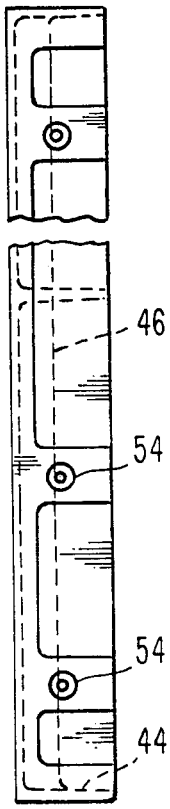
FIG. 9 is a side edge elevational view of the panel of FIG. 7, as shown from the left of FIG. 7.
Figure 7:
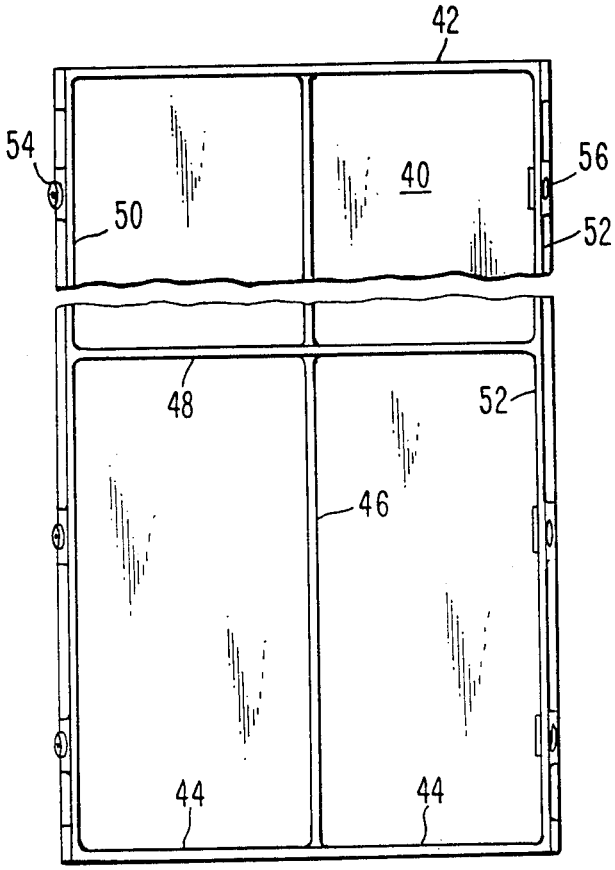
FIG. 7 is an elevational view of the panel shown in FIG. 6, showing the outerface thereof, a portion of the panel being broken away.
Figure 8:
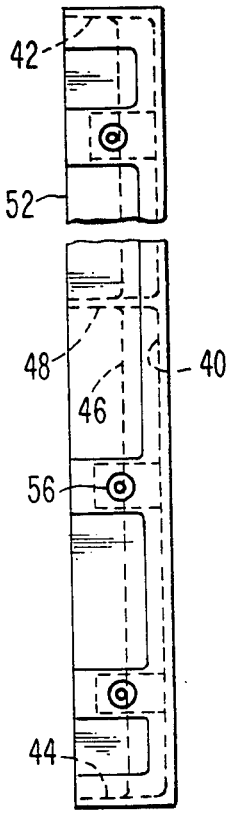
FIG. 8 is a side edge elevational view of the panel of FIG. 7 as seen from the right of FIG. 7.

Thus, if the width of the web of each panel is by way of example regarded as dimension "Z" in FIGS. 1 and 6, and if the inventoried panels are typed according to whether they have angles "X" or whether on the other hand they have angles "Y", then a typical inventory of modular panels designated A through G might be formed as follows:

| Panel | Type | Angle | Dimension "Z" (in inches) |
|---|---|---|---|
| A | X | 96° | 22.57 |
| B | X | 91.5° | 22.61 |
| C | X | 95° | 23.00 |
| D | X | 97.5° | 25.42 |
| E | Y | 83.5° | 18.45 |
| F | X | 91.5° | 21.98 |
| G | X | 97.5° | 16.18 |

In such an inventory, the radius of a section of a swimming pool wall comprising a series of abutting panels A would be approximately 9 feet; a wall section comprising panels B would be curved on a 36 foot radius; panels C, 11 feet; panels D, 8 feet; panels E, 7 feet; panels F, 35 feet; and panels G, 5 feet.

The tabular information set forth above is intended only to provide a typical example of an inventory that would be maintained by a swimming pool manufacturer in accordance with the present invention. The number of inventoried modular panels, the angles X or Y thereof, the dimensions "Z", and the radii on which sections of the swimming pool wall would be curved, are purely exemplary, and approximate.

Utilizing, by way of example, an inventory of modular panels of the type, and having the angle and dimension values set forth above, one can install swimming pools of a limitless variety of shapes and sizes. Parenthetically, it may be noted that it would be obvious that in addition to the panels previously described herein, the manufacturer would also store panels in which the outer faces of the side flanges are exactly perpendicular to the plane of the panel web, wherever the pool wall has a straight portion.

Figure 10:
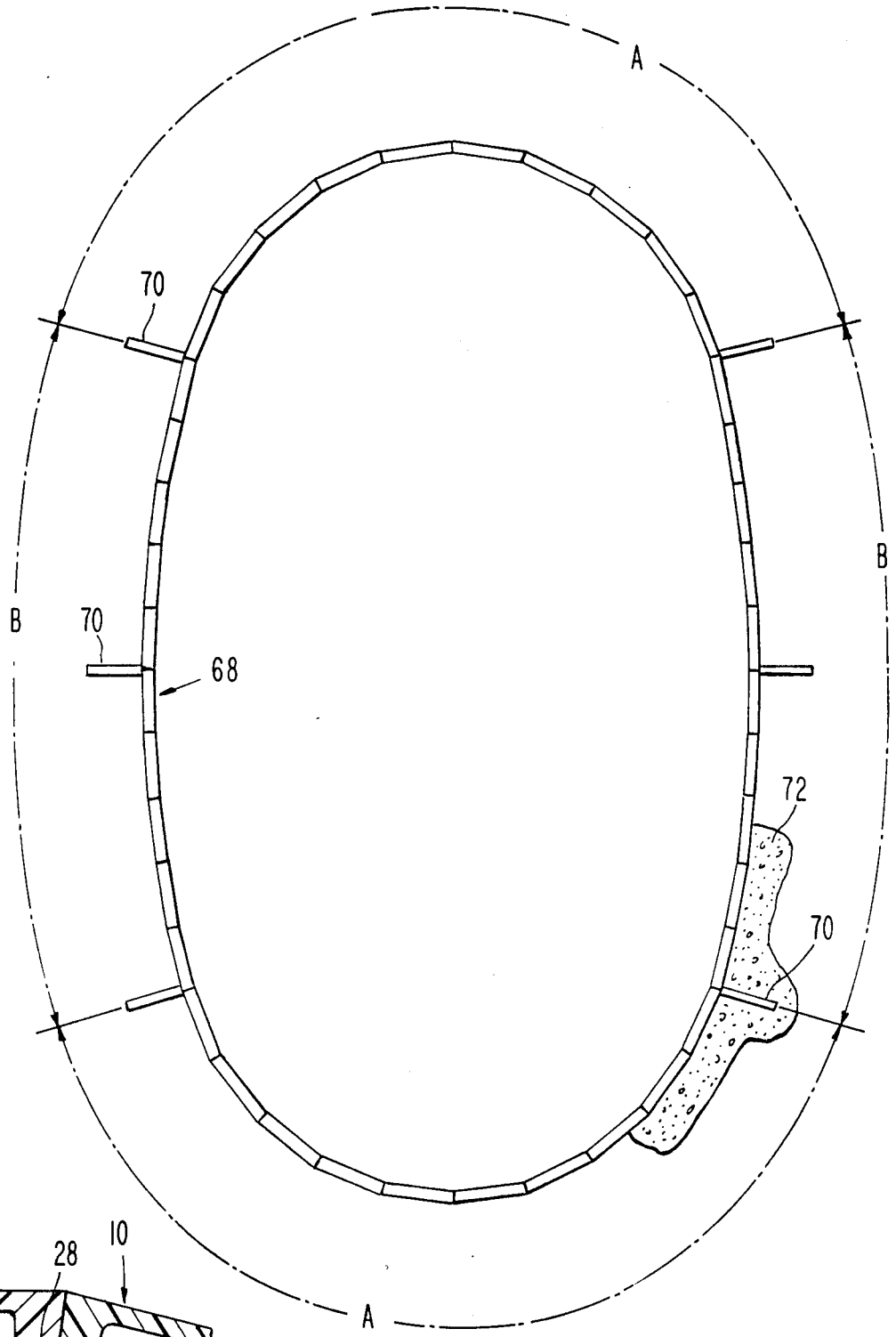
FIG. 10 is a plan view of an oval swimming pool showing one type of pool that can be constructed by use of the modular wall system comprised in the present invention.
Figure 5:
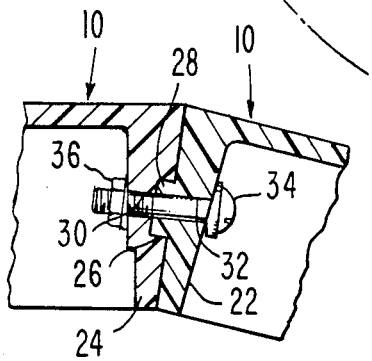
FIG. 5 is an enlarged, fragmentary, detail sectional view showing the connection of adjacent panels to each other as seen on the line 5—5 of FIG. 2.

Referring by way of example to FIG. 10, it may be noted that there is here illustrated a typical swimming pool wall 68, which would be braced at selected locations by swimming pool wall bracing structures 70 such as, for example, those disclosed in the above mentioned Adam et al. patent. These would be anchored in concrete in the manner disclosed in the Adam et al. patent and illustrated schematically at 72 in FIGS. 10 and 12, and the excavation around the swimming pool wall would be back-filled in a manner well known in the art.

For the purposes of the present application, it is mainly important to note that if the customer should desire, for example, an oval pool such as shown in FIG. 10, this can be constructed to a size selected by the customer by the use of a series of 10 A panels at each end of the pool, and 10 B panels along each side. The final effect is to provide, visually, a smoothly curving pool. This is because the radius of curvature of the series of "A" panels at each end of the pool would be quite large, on the order of about 9 feet in the illustrated example. The radius of curvature of the wall section comprising panels "B" at each side of the pool would be even larger, approximately 35 feet in the illustrated example. In view of the relatively narrow width of each panel, the ordinary observer views each curved portion of the pool as being on a true, continuous curve, rather than comprising a plurality of flat-surfaced panels connected end to end in abutting relation.

Figure 12:
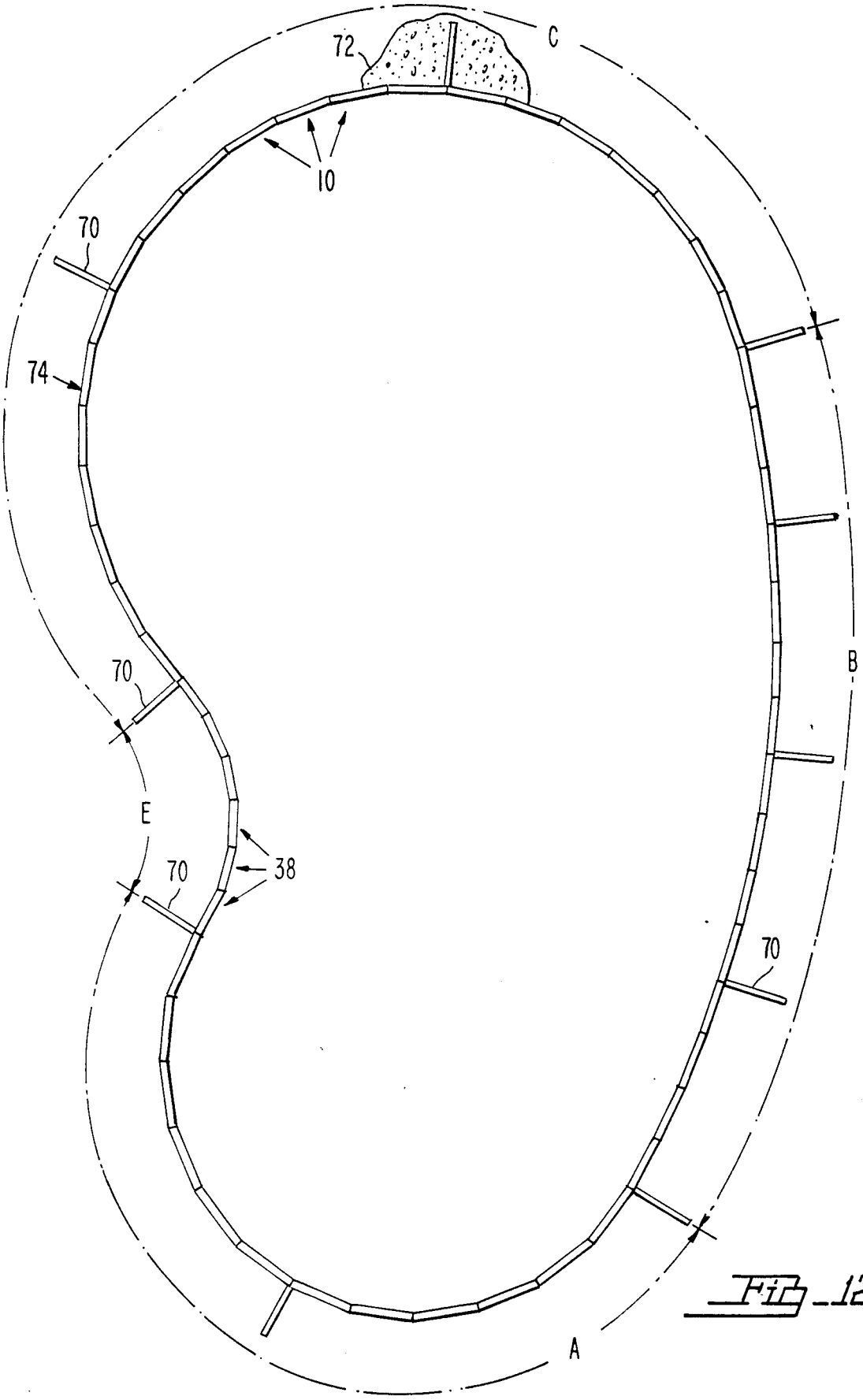
FIG. 12 is a plan view of another wall structure utilizing the modular wall system comprising the present invention for construction of a kidney-shaped pool.

Another example of a typical usage of the modular wall system is shown in FIG. 12. Here the swimming pool 74 includes series of 21 C panels; 15 B panels; and 12 D panels in end to end relationship, with a series of 6 E panels intervening between the "C" and the "D" series to form a reentrant, curved portion of the swimming pool wall, thus providing a kidney-shaped pool one end of which is curved on a much larger radius than the other end. The series of "C" panels is curved, approximately, on an 11 foot radius; the "B" panels, a 36 foot radius; and the "D" panels, an 8 foot radius. The "E" panels are curved oppositely to the others used in this particular installation, on a radius of approximately 7 feet.

It will be seen from the above that the possibilities for varying the swimming pool shapes and designs are almost limitless, with a requirement of maintaining an inventory of no more than, in the illustrated example, about 7 "X" and "Y" type panels, together with a panel used for forming conventional, completely straight sections of the swimming pool wall. In actual practice, when the customer has selected a particular shape and pool size, the pool can be swiftly laid out and planned, and there would be shipped to the site the exact number and type of panels appropriately marked, needed to construct the swimming pool according to the plan drawn up for the customer. Thereafter, the swimming pool is erected utilizing completely conventional methods for construction of swimming pools of the vinyl-lined type.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A modular swimming pool wall system for use in constructing a swimming pool wall of the vinyl-lined type, comprising:

(a) a first group of panels each of which is formed as a one-piece member having end and face surfaces wholly devoid of curvature, said member including (1) a web having a face surface that is flat over the entire area of the web, said surface facing inwardly of the swimming pool that is being constructed to provide a backing surface for a liner within which water is to be confined in said pool, (2) top, bottom, and side flanges, all of which are integral with the web and extend outwardly of the pool from the web, said side flanges having wholly flat faces constituting said end surfaces, (3) means for interengaging and for joining together the side flanges of adjacent panels in abutting, face-to-face relation, the end surfaces on the side flanges of each panel being at predetermined obtuse angles to the plane of the web surface of the panel, said angles of each panel and the transverse dimension thereof as measured from one to the other of its side flanges, combining to form each group in the visual semblance of a true and continuous curve having a radius predetermined by said angles and dimension; and (b) at least one additional group of panels formed similarly to those of the first group, with the exception that each panel of the additional group has the end surfaces on its side flanges at obtuse angles to the plane of its web surface, that are different from the corresponding obtuse angles of the panels of the first group.

2. A modular wall system for use in constructing a swimming pool wall as in claim 1, wherein each panel is formed wholly of a high impact polystyrene.

3. A modular wall system for swimming pool walls as in claim 1 wherein the means for interengaging the side flanges of adjacent, abutting panels comprises male bosses extending outwardly from one side flange of each panel, the other side flange of each panel having recesses receiving the bosses of an adjacent panel.

4. A modular wall system for use in constructing swimming pool walls as in claim 1 further including reinforcing means integral with the web of each panel for maintaining said web in a wholly flat condition over its entire area.

5. A modular wall system for use in constructing a swimming pool wall as in claim 4, wherein said reinforcing means comprises crossing ribs integral with the web.

6. A modular wall system for use in constructing a swimming pool wall as in claim 5, wherein the said ribs are also integral with the top and bottom flanges.

7. A modular swimming pool wall system for use in constructing a swimming pool wall of the vinyl-lined type, comprising:

(a) a first group of panels each of which is formed as a one piece member having end and face surfaces which are wholly free of curvature, said member including, (1) a web having a face surface flat over the entire area of the web and facing inwardly of the swimming pool that is being constructed to provide a backing surface for a liner within which water is to be confined in said pool, (2) top, bottom and wholly flat side flanges providing said end surfaces, all of which are integral with the web and extend outwardly of the pool from the web, (3) means for interengaging and for joining together the side flanges of adjacent panels in abutting, face-to-face relation, the end surfaces on the side flanges of each panel being at predetermined obtuse angles to the plane of the web surface of the panel whereby said angles will combine with the transverse dimension of the web surface to determine a radius about which said group will be curved, said angles and transverse dimensions being selected to give said group the appearance of a true continuous curvature;

(b) at least one additional group of panels formed similarly to those of the first group, with the exception that each panel of the additional group has the end surfaces on its side flanges at obtuse angles to the plane of its web surface, that are different from the corresponding obtuse angles of the panels of the first group; and (c) at least one third group of panels formed similarly to those of the first group and said one additional group, with the exception that each panel of the third group has the end surfaces on its side flanges at acute angles to the plane of its web surface.

8. A wall for forming free form swimming pools, composed of at least two series of connected, like, side-by-side panels all of which have end and face surfaces wholly devoid of curvature, each series merging smoothly into the next adjacent series and being curved to a selected, given radius different from that of any other series, each panel comprising:

(a) a rectangular, flat, upstanding web;

(b) a pair of flat side flanges integral therewith and extending outwardly from the plane of the web in the sense of a pool area defined by said wall; and (c) means for connecting adjacent side flanges of side-by-side panels in facially contacting relation, there being two types of panels among the several series, normally a panel type X in which the planes of the side flanges thereof lie at an obtuse angle to the plane of its web, and a panel type Y in which the planes of the side flanges are at acute angles to the plane of the web, whereby a series of X panels will curve outwardly and a series of Y panels will curve inwardly in respect to said pool area, each panel further including a dimension Z extending as a measurement across the inner surface of its web from one to the other of its side flanges, the relative values of the angles and the Z dimension of each panel combining to determine the radius of that series, the combination of the angles and Z dimension of the panels of each series being different from the corresponding combination in the panels of any other series whereby the radius of each series will differ from that of the remaining series, said combination on each series being selected to impart thereto the visual appearance of a true continuous curve when its panels are disposed side-by-side with their adjacent side flanges connected in facially contacting relation.

* * * * *